United States Patent [19]

Clark

[11] Patent Number: 4,492,159

[45] Date of Patent: Jan. 8, 1985

[54] POSTAGE PRINTING APPARATUS HAVING A PRINT HEAD WITH A REPLACEABLE RIBBON CARTRIDGE

[75] Inventor: John I. Clark, Milford, Conn.

[73] Assignee: Pitney Bowes Inc., Stamford, Conn.

[21] Appl. No.: 473,842

[22] Filed: Mar. 8, 1983

[51] Int. Cl.[3] ..... B41J 32/00; B41F 11/00

[52] U.S. Cl. ..... 101/71; 101/336; 400/203; 400/234

[58] Field of Search ..... 101/71, 336, 91, 244, 101/52, 235, 53, 57, 59, 65, 69, 70, 74, 75, 76, 80, 93.05, 93.01, 93.08, 93.11, 93.12, 93.17, 92.27, 93.41, 93.42, 93.47, 233, 234, 236, 237, 238, 273, 274, 216, 245, 247, 332, 375; 400/203, 234, 196.1, 196, 682, 48, 617, 161.5, 56, 57, 59, 194, 195, 140, 141, 142, 141.1, 145, 145.1, 145.2, 208, 159, 653, 489, 96, 124, 636; 340/365 VL; 83/160, 528, 529

[56] References Cited

U.S. PATENT DOCUMENTS

| | | | |
|---|---|---|---|
| 785,709 | 3/1905 | Burridge | 400/196 |
| 991,203 | 5/1911 | Ernst | 101/52 |
| 1,433,181 | 10/1922 | Cossitt | 400/203 |
| 2,412,472 | 12/1946 | Ryan | 101/91 |
| 2,586,905 | 2/1952 | Bates | 101/244 |
| 3,869,986 | 3/1975 | Hubbard | 101/91 |
| 4,278,023 | 7/1981 | Call | 101/235 |
| 4,373,823 | 2/1983 | Albrile | 400/196.1 |

FOREIGN PATENT DOCUMENTS

| | | | |
|---|---|---|---|
| 594026 | 10/1947 | United Kingdom | 101/336 |

*Primary Examiner*—Clyde I. Coughenour
*Attorney, Agent, or Firm*—Joseph A. Sawyer, Jr.; William D. Soltow, Jr.; Albert W. Scribner

[57] ABSTRACT

A postage meter printing apparatus for applying postage indicia to a mailpiece having a cyclically operating drum for feeding the mailpiece through the postage meter. The periphery of the drum has an aperture therein. Structure is provided to maintain the mailpiece against the drum as the mailpiece is fed by the drum and to cycle the drum. A matrix print head located internal to the drum has a printing position and non-printing position. The print head is automatically placed adjacent the mailpiece through the aperture in the drum to its printing position, when the aperture is between the print head and the mailpiece. The print head is a matrix print head of impact or other type and includes a cooperating ribbon either inked or other to print on the mailpiece. The inked ribbon is contained in a replaceable cartridge. Structure is provided to activate the print head when it is in its printing position. The circumference of the drum may be fitted with a letterpress printing plate to allow simultaneous matrix printing of variable data and conventional rotary letterpress printing of repetitive data.

5 Claims, 41 Drawing Figures

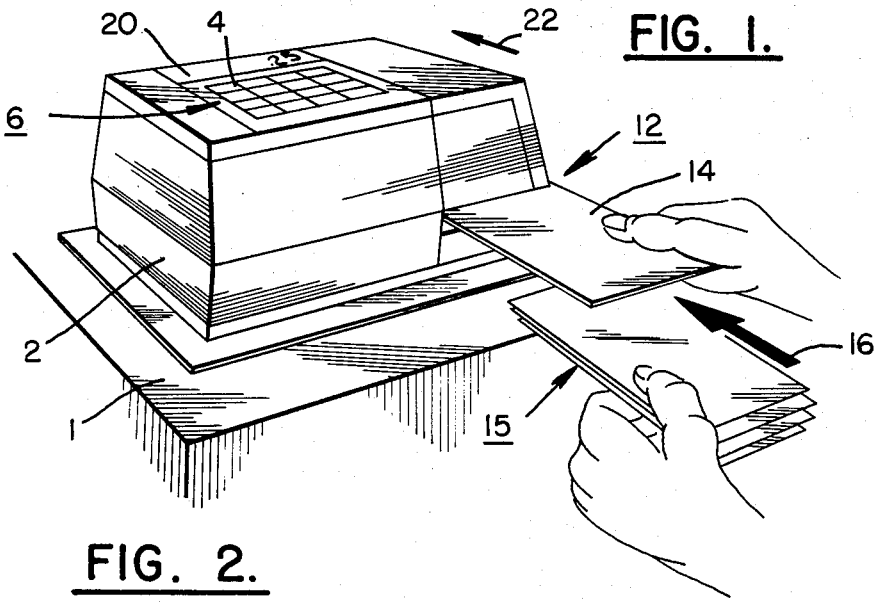
FIG. 1.
FIG. 2.
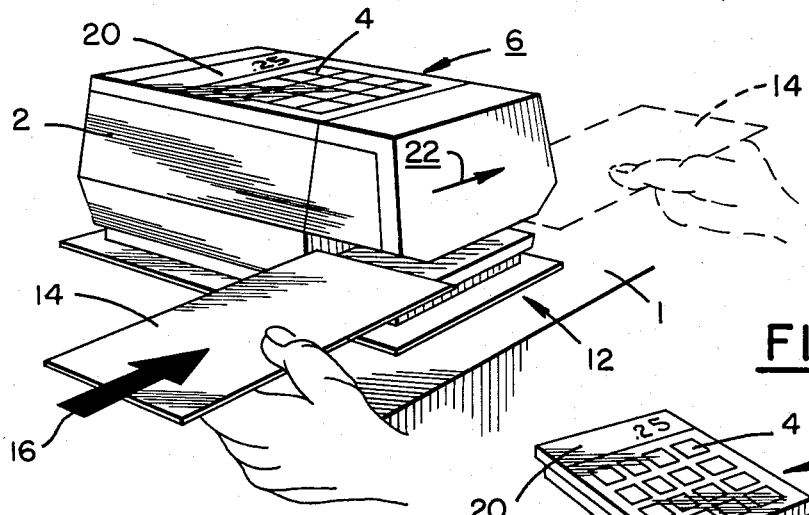
FIG. 3.
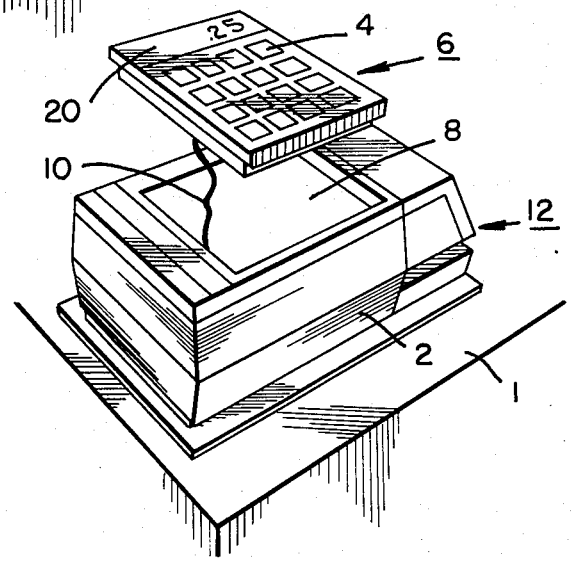

POSTAGE PRINTING APPARATUS HAVING A PRINT HEAD WITH A REPLACEABLE RIBBON CARTRIDGE

BACKGROUND OF THE INVENTION

Reference is hereby made to other related patent applications which are assigned to the same assignee as the present application; Application-of J. Clark entitled "Postage Printing Apparatus Having A Movable Print Head In A Print Drum", Ser. No. 473,418, Filed On Mar. 9, 1983; Application of J. Clark and A. Eckert entitled "Postage Printing Apparatus Having A Movable Print Head And A Variable Speed Drum Rotation", Ser. No. 473,843, Filed On Mar. 9, 1983; Application of J. Clark entitled "Postage Printing Apparatus Having A Movable Print Head And A Hollow Non-Rotating Support Shaft", Ser. No. 473,831, Filed On Mar. 9, 1983; and Application of J. Clark entitled "Postage Printing Apparatus Having A Movable Print Head And A Rotating Print Drum And Ribbon Cartridge", Ser. No. 473,418 Filed On Mar. 9, 1983;

This invention relates to postage or ticket printing and, more specifically, to a postage meter having a printing drum in which there is incorporated an internal print head for printing the variable data portion of the postage indicia. The movement of he drum through its cycle of operation automatically coordinates the positioning of the internal print head to produce the complete postage indicia.

Postage meters for the application of indicia to a mailpiece are in general use today and thus are well know. The postage meter system prints pre-selected postage onto mailpieces or to adhesive-backed labels which are, in turn, applied to mailpieces. The operator pre-selects the value of the postage to be printed by punching it into a keyboard data entry unit in the system. In other systems the value of the postage may be automatically selected by scale and/or rate computer. Before using he meter the first time each day, the operator adjusts the date printed by the system to assure it conforms to the date the article is to be mailed. The day may also be automatically set by an associated digital clock. The value and date information is generally regarded as the variable data within the postage indicator be imprinted on the mailpiece. In addition, fixed data may be and is generally used in the indicia. The fixed data may include the city and state of the originating mailpiece, the meter number, advertisements and other such information. In addition to postage meters, other types of imprinters may use a similar approach to printing control data in a manner similar to postage meters. These include parcel services, tax stamps, check writing services, tickets, and the like.

Because some of the data placed in the indicia, such the date and he value of the postage, must be variable, two printing sections for the indicia are generally combined by the postage meter to print the complete indicia, one section for the fixed data and one for the variable data. One such approach is to use a rotatable printing drum having die plates mounted on its periphery that are adapted to print fixed information. Also located on the periphery of the drum, in the vicinity of the die plates, are a group of settable print wheels which are adapted to print variable information such as the date and postage value. The settable print wheels project through suitable apertures formed in the curved surfaces of the print drum and rotate with the drum. When the drum is rotated or cycled, the die plates and print wheels are suitably inked so as to be capable of imprinting a composite indicia or marking of the fixed and variable data on a mailpiece. In order to vary or pre-set the postage value, a keyboard on the system is used to enter the value desired which automatically varies the operative positions of the print wheels to reflect the desired value. The linkage for setting and changing the print wheels requires an extremely intricate and mechanically complex arrangement. The print wheels are first set to selected rotary positions from the keyboard and then are bodily swung through a rotating printing path in conformance with the movement of the printing drum. The date is normally advanced each day by hand in this type of system. This system provides a way to print fixed and variable data at one printing station with one cycle of he drum.

Another device that carries out the general function described above has the fixed information on a relatively flat die plate-like element with the variable information operably contained within the element. The variable data is implemented by settable print wheels which project through apertures in the die-like element. In this latter device, a mailpiece is placed under the element and a movable platform, which forms the bottom of the letter slot drives the mailpiece up into the element after the latter has been set at the desired value and inked to create the indicia on the envelope.

In third type of known device, the print wheels and associated setting linkages described above and used for the variable data are dispensed with and replaced with an electronically controlled ink jet printing device. This type of apparatus is disclosed in U.S. Pat. No. 3,869,986, assigned to Pitney Bowes, Inc., Stamford, Connecticut. In this device, the drum carries an apertured printing die plate which cooperates with a stationary ink jet printing device located in the drum to produce a composite postage imprint. One aperture is for the data and another for the postage amount. The die plate imprints the fixed data. As the apertures in the die plate pass below the ink jet printing device, plurality of inked droplets are sequentially ejected through the apertures and onto the mailpiece located at the meter print station. an electronic control is provided to actuate the ink jet printing device in timed relation to the movement of the die plate to form the required number and placement of ink drops on the envelope. This forms the variable data in the indicia; that is, the date and postage value. The device relies on a drum position sensor to determine when the die plate apertures are properly aligned with the ink jet printing device and the postage-receiving portion of the mailpiece. A print signal is generated by the sensor and applied to the electronic control to initiate a sequenced projection of the inked droplets There has been a need for a compact, low cost and reliable postage meter. It is desirable to produce such a meter which does its printing at one print station so that registration problems and associated costs are avoided. It is desirable to have the mailpiece compressed sufficiently as the indicia is being applied to it so that print quality standards are met in every cycle. The meter must also meet the usual standards of integrity and security. Although low cost, the meter design desirably should have a high rate of throughput in applying postage indicia for improved convenience and more efficient mail processing.

SUMMARY OF THE INVENTION

This invention relates to a postage meter printing apparatus for applying postage indicia to a mailpiece having a cyclically operating drum means for feeding the mailpiece through the postage meter, the periphery of the drum means has an aperture therein. Means are provided for maintaining the mailpiece against the drum means as the mailpiece is fed by the drum means, and for cycling the drum means. Print head means is located internal to the drum means having a printing position and non-printing position, the print head means is automatically placed adjacent the mailpiece through the aperture in the drum means to its printing position when the aperture is between the print head means and a mailpiece. The print head means is typically an impact matrix print head and includes a cooperating inked ribbon means to print on the mailpiece. The inked ribbon means is contained in a replaceable cartridge. Also included is means to activate the print head means when it is in its printing position.

In one form of the invention the replaceable cartridge is mounted in the drum means. The drum means may include a generally circular plate. The replaceable cartridge may extend through an aperture disposed in the plate.

In some forms of the invention the replaceable cartridge has first and second arms which are disposed in generally parallel relationship. The ribbon may extend between the first and second arms. During at least a portion of the cycle of the apparatus the ribbon may be disposed intermediate the first and second arms within a single plane.

BRIEF DESCRIPTION OF THE DRAWINGS

The objects and advantages of the improved postage printing device and method disclosed herein may be understood from the following description of the preferred embodiment as illustrated in connection with the drawings wherein:

FIG. 1 is a schematic illustration of the exterior of the postage meter with the mailpiece being loaded by an operator located at the side of the meter.

FIG. 2 is a schematic illustration of the exterior of the postage meter with the mailpiece being loaded by an operator located at the front of the meter.

FIG. 3 is a schematic illustration of the exterior of the postage meter with the control panel module disengaged from the body of the postage meter in preparation for being re-oriented relative to the body.

FIGS. 20–26, section (b) only, are sequential views of FIG. 18 at different points in the cycle of the print drum.

FIGS. 20–26, section (c) only, are sequential views of FIG. 19 at different points in the cycle of the print drum.

DETAILED DESCRIPTION OF THE PREFERRED EMBODIMENTS

Figure 4:
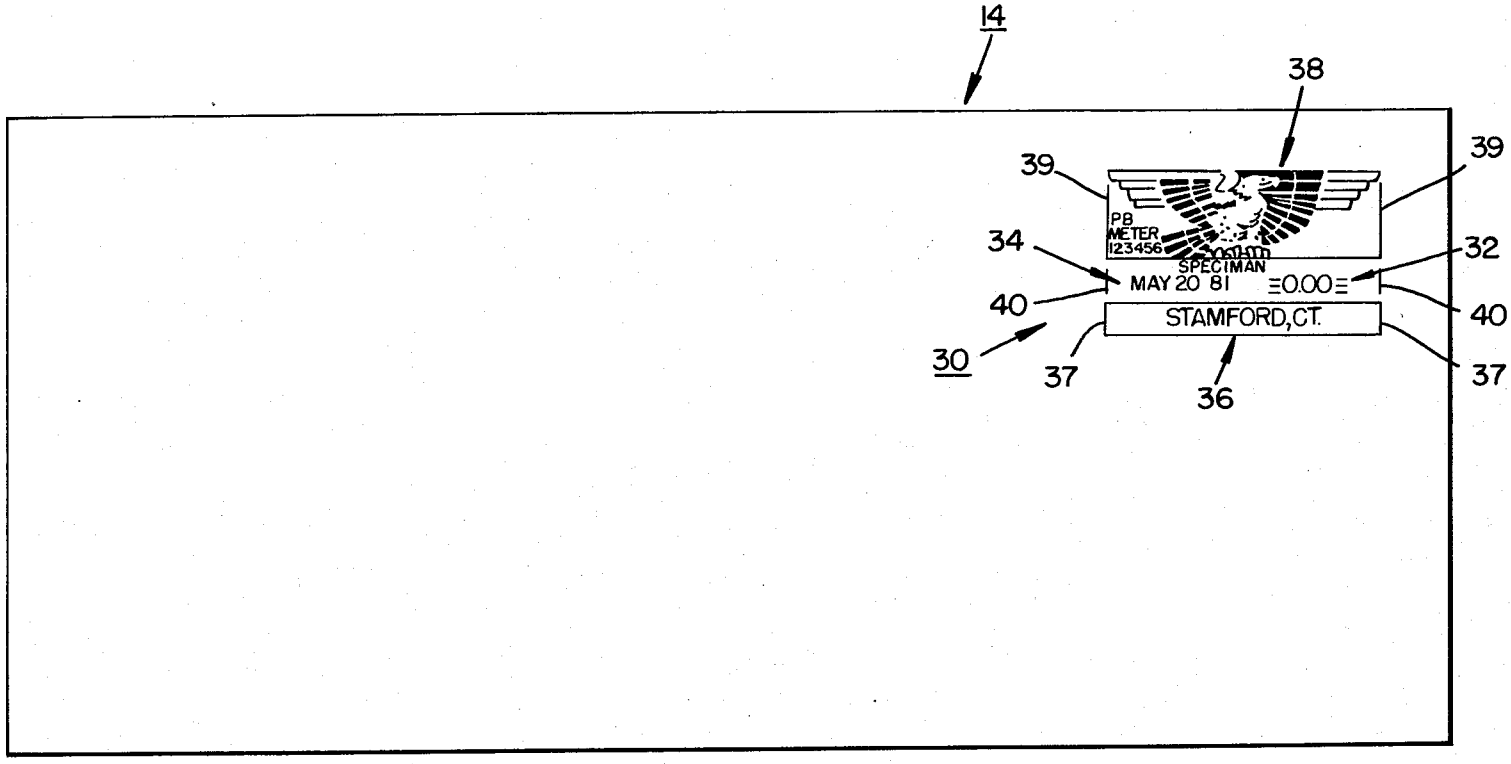
FIG. 4 is a schematic illustration of an indicia placed on a mailpiece by the meter.

Except as otherwise provided herein, the instant postage meter apparatus may be constructed and arranged in a manner similar to that of presently known postage meters and associated apparatus. Therefore, the following description concentrates on those components of the postage meter and their operation which pertain to the invention. The remaining components of the postage meter system may be conventional and are described in a general manner to show the cooperation they have with the invention.

The present invention is an improvement over presently known postage meters such as models 5300 and 6300 postage meters manufactured by Pitney Bowes, Inc., Stamford, Connecticut. In addition to the printing module, postage meter systems include an information input module, such as a keyboard for entry of data into the meter and a display for exhibiting certain information in the meter, and a control module for controlling the operation of the system. U.S. Pat. 3,978,457,assigned to Pitney Bowes, discloses a postage meter system which uses a microcomputer set for a control module.

This invention is disclosed in the context of a postage meter, however, other types of meters may have the invention applied thereto with equal success and these include parcel service meters, tax stamp meters, check writing meters, ticket imprinters, and other similar devices.

FIGS. 1 and 2 are external views of the low cost postage meter in accordance with the invention. The postage meter has an external cabinet 2 with a control panel module 6 located on a top surface thereof. The control panel module 6 is understood to contain all of the features of a conventional postage meter including a keyboard 4 for entering the value of the postage and other data and a display 20 for displaying the value chosen and other data that is useful in the operation of the machine.

FIG. 1 depicts the postage meter, supported by Table 1, receiving a mailpiece 14. Arrow 16 shows the direction in which the mailpiece 14 is to be fed into the machine. Mailpieces 14 are fed as a stack 15 as shown in FIG. 1 to have postage applied thereto. In this embodiment, the operator can hold the stack one hand and feed or "deal" each mailpiece 14 one at a time in rapid sequence into a slot 12. Mailpieces 14 are fed out of the machine after postage is applied.

FIG. 2 shows the postage meter being loaded with the mailpiece 14 by an operator located in front of the machine. The operator in this embodiment stands in front of the machine and feeds mailpiece 14 into slot 12 in the direction indicated by arrow 22. After mailpiece 14 has had postage applied, the operator can conveniently catch the mailpiece (shown in dotted lines).

As seen in FIG. 3, a control panel module 6 may be lifted out of cabinet 2 and orientated conveniently either to the front or the side of the machine. The cabinet 2 contains a panel module holder 8 from which the control panel module 6 may be removed and replaced in a re-oriented position. The control panel module 6, in the embodiment shown, contains both the keyboard 4 and the display 20 as well as other devices related to the control of the machine. The control panel module 6 is connected to the electronic controls (not shown) of the postage meter by a control cable 10.

FIG. 4 shows a sample mailpiece, or envelope 14, having the postage meter-applied indicia 30 to create a meter stamp on the envelope. The term "indicia" is used herein as a general term which is intended to mean the complete printing or print work that is applied by the postage meter onto the mailpiece 14. The indicia 30, in this embodiment, contains a postage value 32; a date 34 the stamp was made; city and state of origin 36; and an insignia with the postage meter number and country of origin 38. Two edges, 37, of the city and state of origin may be aligned with the two respective edges, 39, of insignia 38 for security purposes. The two lines, 40, printed with date 34 and value 32 by a suitable print head, such as a matrix print head, can be aligned precisely with edges 37 and 39. If, upon visual inspection, these edges are not in alignment, the indicia can then be suspected as being a fraudulent one. The indicia 30 may further include advertising, not shown in FIG. 4, alongside the indicia 30 shown, which may also be applied by the postage meter.

The portion of the indicia 30 in FIG. 4, which relates to the value 32, and the date 34, is the variable portion of the indicia 30. The remaining portions of the indicia 30, such as the insignia 38, and the city and state 36, are the fixed portions of the indicia 30. The variable portions of the indicia 30 may, in some respects, such as value, vary each time the postage meter makes a print cycle. On the other hand, the fixed portion of the indicia 30 basically remains the same for each print cycle made by the postage meter.

The postage meter disclosed herein enables the entire indicia 30, both the fixed and the variable portions, to be printed at a single station during a cycle of the apparatus. The apparatus has a high mailpiece throughput rate. Referring particularly to FIGS. 5–8, a preferred embodiment of the postage meter print drum 50 has a variable indicia printing system, in this case an impact matrix print head 114, mounted within the rotating print drum 50 to print the entire indicia 30 in a single rotation of the drum 50. The non-rotating print head 114 prints through a slot 80 in the print drum 50 enabling substantially concurrent matrix printing of variable and fixed data.

Figure 5:
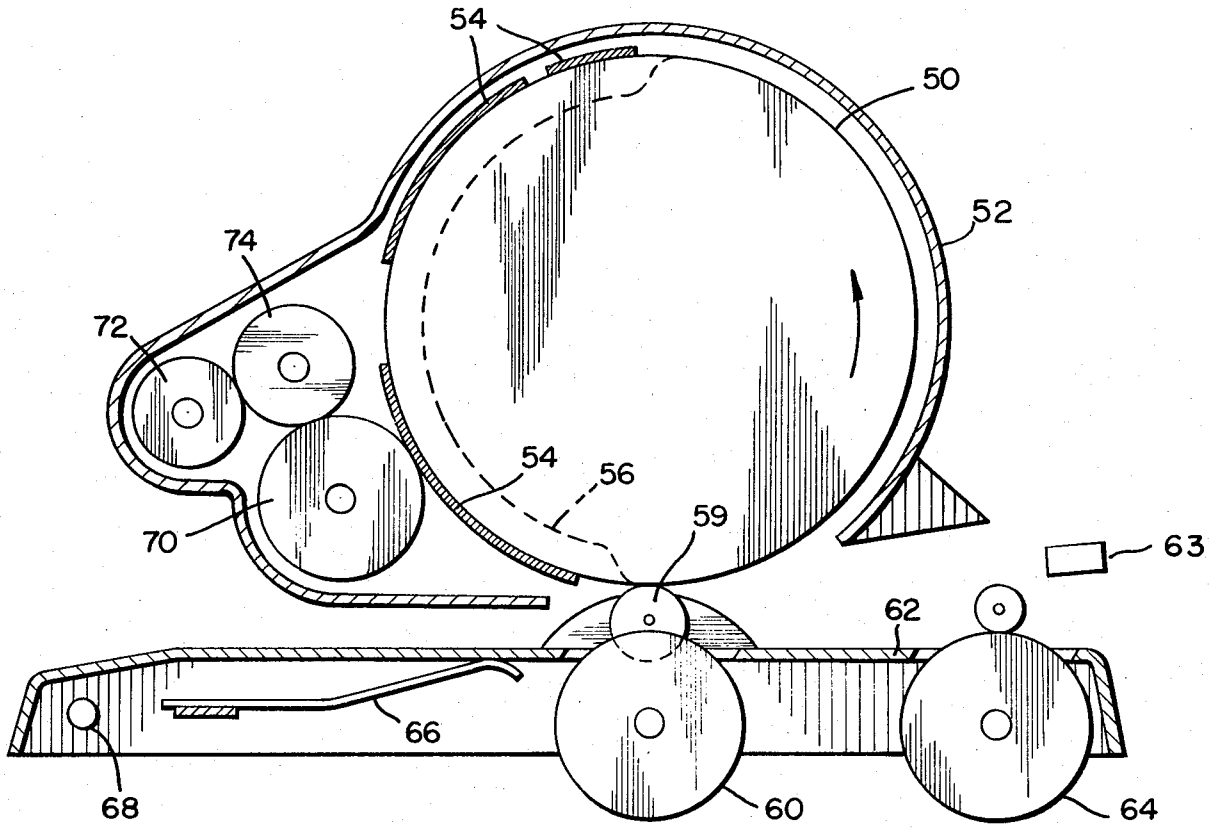
FIG. 5 is a schematic illustration of the printing drum, mailpiece deck and impression roll, without the internal printing mechanism for printing variable data.

FIG. 5 is a partial view of the postage meter apparatus which includes the print drum 50, the mailpiece deck 62 and the impression roller 60. For the purpose of simplicity, FIG. 5 does not include the internal impact matrix printing mechanism 110 by which the variable data is printed. The print drum 50 has attached thereto printing plates 54, that print the fixed portion of the indicia 30. The drum 50 is mounted and journaled for rotation in the counter clockwise direction shown by the arrow by any suitable drive and control means. The drum 50 rotates such that plates 54 rotate past an inking roller 70. The roller 70 supplies ink to the plates 54 as they pass over it. Ink can be supplied to the roller 70 by the transfer rollers 72 and 74 which are coupled to any conventional ink supply (not shown). Alternatively, any conventional ink supply can be used to supply ink directly to roller 70 without the use of transfer rollers 72 and 74. The drum 50 and the inking roller system 70 are surrounded by a housing 52.

The impression roll 60, which is carried by the mailpiece deck 62, is located under the drum 50. The mailpiece deck 62, impression roller 60 and the inking roller 70 form a printing station where the indicia 30 is placed on the mailpiece 14. The deck 62 pivots about a point 68 and carries a cam follower 59 which follows the cam 56 fixed to the rear of the drum 50 (also shown in FIG. 10) due to the bias action of a spring 66. The deck 62 and its components, as well as any mailpiece 14 thereon, are biased toward the print drum 50. The distance from the drum 50 can be determined by the cooperating action of the cam 56 and the follower 59. The apparatus can also have an upstop member 63 which ultimately limits the pivoting of the deck 62, and impression roll 60 towards the drum 50. The deck mechanism 62 also includes an exit roller 64.

The plates 54 are inked by roller 70 and brought into contact with mailpiece 15 to print the fixed portion of the indicia. Thereafter the slot 80 in the drum 50 passes adjacent the mailpiece 14, the variable indicia to be printed thereon. A driven exit roll 64 further aids the movement of the mailpiece 14 to the right after printing contact with the drum 50 has been completed.

In the typical case when postage is placed on the upper right hand corner of an envelope 14, the envelope 14 would have its postage indicia 30 printed just after the leading edge of the envelope passed through the printing station. The slot 80 and a printing plate 54 on the drum 50 would be located to arrive at the station accordingly.

The system is designed so that the vertical motion of the deck 62 and the impression roller 60 are synchronized to rotation of the drum 50 without the use of expensive or mechanically complex hardware. This is accomplished by the cam 56 mounted on or formed integrally with the drum 50. The impression roller 60 is held depressed and clear of the drum 50 to allow easy entry of the mailpiece 14. Early rotation of the drum 50 allows a controlled rise of the spring-loaded deck 62 until the mailpiece 14 is squeezed between the rotating drum 50 and the impression roller 60. The height of the impression roller 60 may be adjusted by moving the bracket (not shown) on which it is mounted relative to the deck 62.

Figure 9:
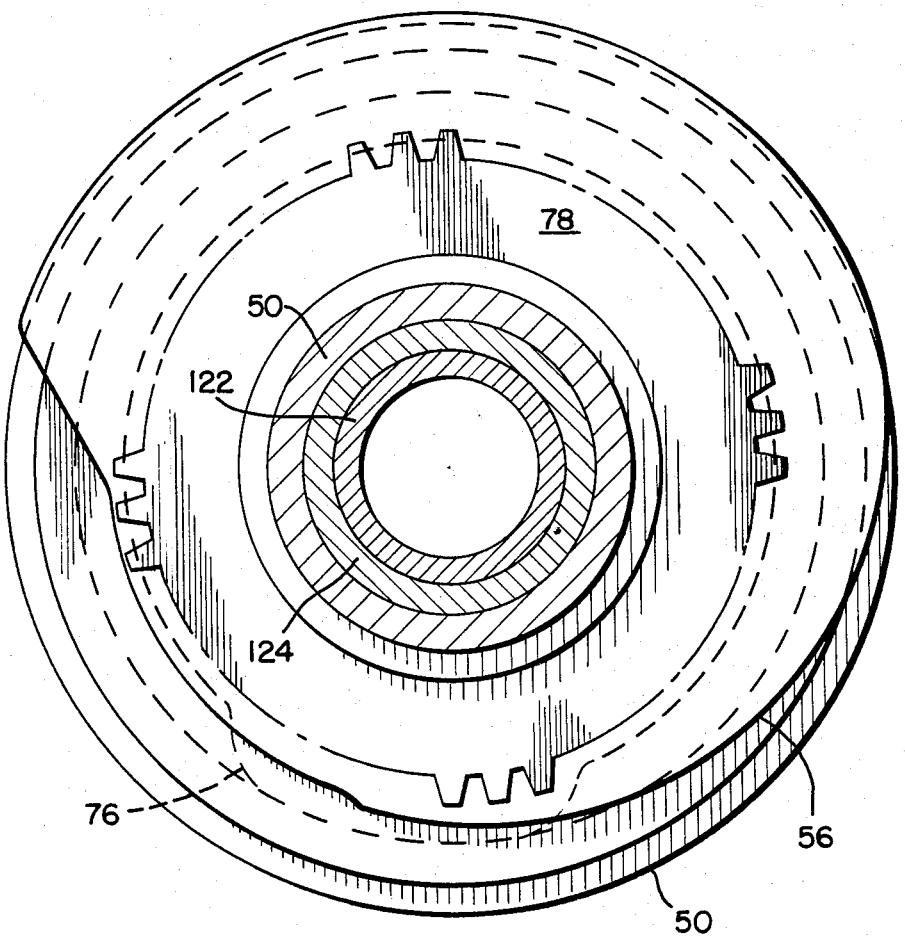
FIG. 9 diagrammatically illustrates the print drum and drum shaft area taken through section A—A of FIG. 8, but without the drum being cut away.

Present commercial postage meters of this type use a rotating solid shaft connected to the print drum 50 to support and cycle the drum 50. The drum 50 shown herein uses a hollow non-rotating shaft 122 (FIG. 9) for supporting the drum 50. The shaft 122 and other related parts of the drum drive are best depicted in FIG. 9 which is described below. The hollow shaft allows the electrical wires to be passed from the main control section of the meter, located outside the drum 50, to the printing head 114 (FIG. 9) located inside the drum 50. The hollow shaft 122 avoids the need to use commutation rings. Additionally, the hollow non-rotating shaft 122 provides a convenient support for the printing head 114 inside the drum 50, optimum utilization of the interior cavity space, and a duct for bringing cooling air into the drum 50.

The drum 50 also features a closed construction. The drum can provide good EMI shielding for the print head 114 and related circuitry, if desired, when made of a conductive material. The enclosed drum construction maintains a reduced level of dust in the area of the print head 114 and its linkage. The enclosed drum 50 also improves the physical security of the system and prevents tampering.

Figure 6:
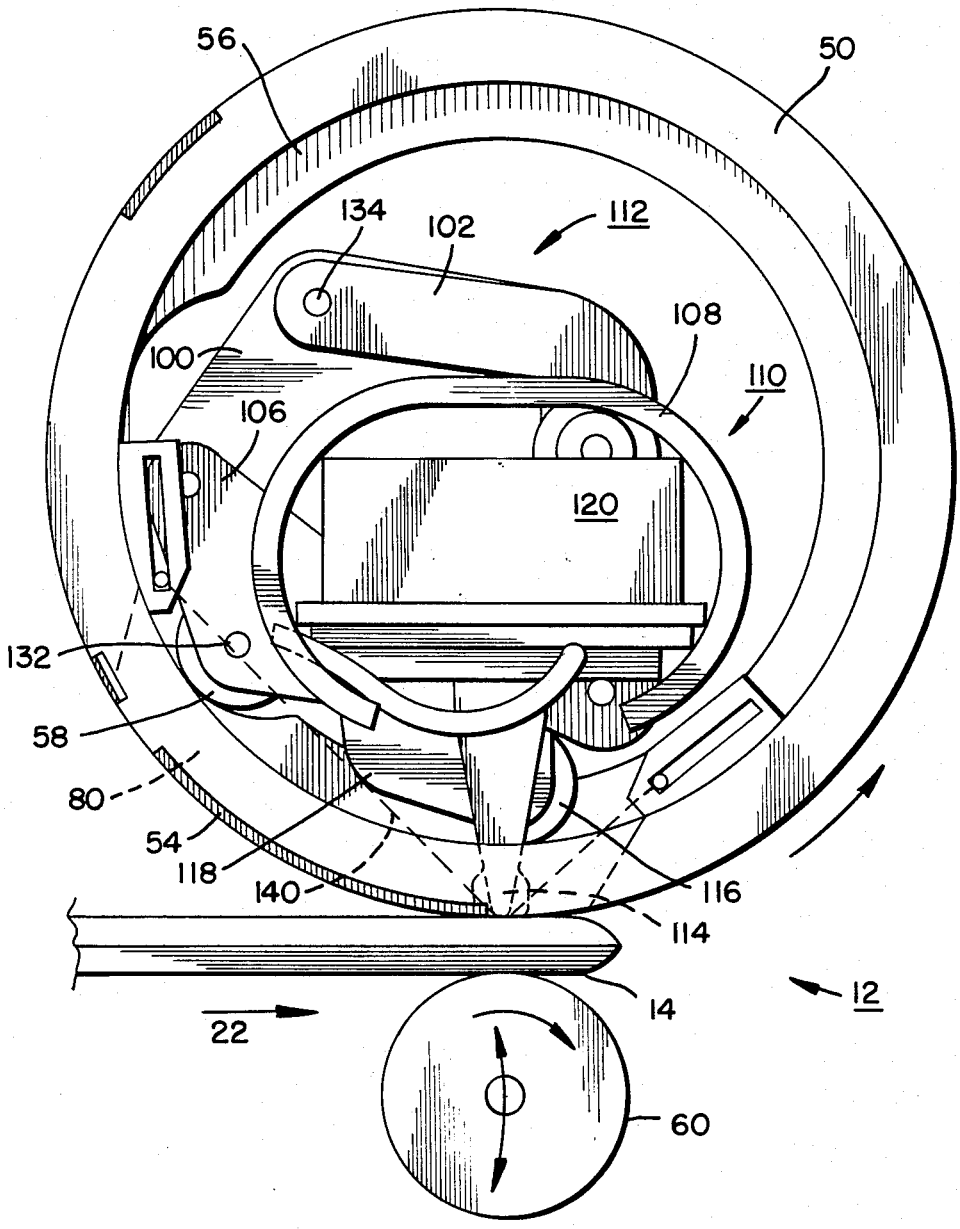
FIG. 6 diagrammatically illustrates a print drum with the internal impact matrix print mechanism looking into the front of the meter drum with the ribbon cartridge and covering components removed.

FIGS. 6–10 are schematic illustrations of various aspects of the print drum 50 and the internal print head assembly 110 for printing variable indicia 30 located within and cooperating with the print drum 50. Referring, more particularly, to FIG. 6, the print head assembly 110 is adapted to reciprocate relative to the drum 50. The assembly 110 moves down into the printing station only when the drum slot 80 is between the print head 114 and the mailpiece 14. Reciprocation of the print head assembly 110 is controlled by the angular position of the drum 50 and the action of the print head positioning assembly 112. The impact matrix print head 114 is lowered with its associated inked ribbon 140 through slot 80 in the drum 50 to print, by the impact of pins through the ribbon 140, variable information on the mailpiece 14. The printing plates 54, as they have rolling contact with the mailpiece 14, print the fixed information thereon. Thereby the fixed and variable information is applied by two different printing processes in one printing cycle. A portion of the interior surface of the drum can be used as a cam surface 76 for the print head positioning assembly 112. The shape of cam surface 76 controls the print head 114 so that it can print only when the slot 80 is located between the mail piece and the print head.

The lowering of the print head 114 is controlled by the cam follower roll 58 which is attached to the print head positioning mechanism 112 and which follows the cam 76 as the drum 50 rotates. A spacer roll 116 drops down onto the inside surface of the drum 50 during printing to correctly space the print head 114 relative to the mailpiece 14. The spacer roll 116, although not essential, is preferable in that is allows the print head 114 to follow the exact shape of drum 50 even though the drum 50 may be slightly out of round.

The ribbon 140 rotates with the drum 50 while the print head assembly 110 does not rotate. Because of this relative movement the print head assembly 110 contains a ribbon guide 108 which acts to guide a ribbon chord 141 not shown FIG. 6 around the print head assembly 110 as the drum 50 carries the ribbon 140 through a complete revolution. While the print head assembly 110 is in its printing position, tension is maintained on the ribbon chord 141 (not shown) by the print head 114 being positioned through the drum slot 80 as shown in FIG. 6.

The impact matrix printing head assembly 110 is conventional and may be Printhead Model Number LRC P/N 10311-002 supplied by Eaton Corporation, Printer Products, Technical Research Park, Riverton, Wyoming 82501 or other apparatus. The print head 114 is of the dot matrix type (seven pins in this example), which has a recommended driver circuit and standard connector for the pin assignments. The inked ribbon 140 used with the print head assembly 110 is also conventional and can be any compatible type. For instance, it can be a ribbon supplied by Curtis-Young Corporation, 2550 Haddonfield Road, Pennsauken, N.J. 08110 identified as "Nylon 44, Black, Medium #4'" in 3/16 inch width.

The impact matrix process requires a relatively solid printing surface to assure availability of maximum impact energy for transfer of ink from the ribbon 140 to the mailpiece 14. Precise location of the printing surface relative to the print head 114 is also important to accommodate the relatively short stroke of the print head pins. Both requirements, while readily met in commercial printers, require special consideration when the process is used on a mailpiece 14 in a postage meter.

Figure 11:
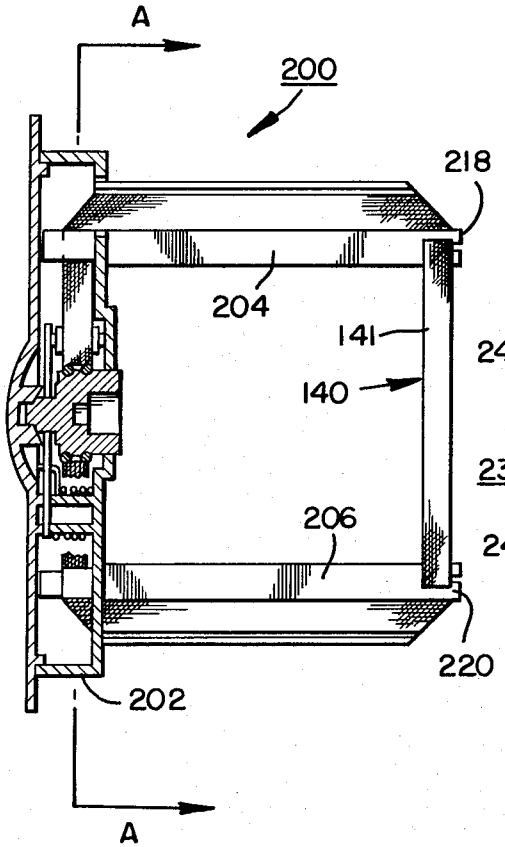
FIG. 11 is a cross-section view of the ribbon cartridge.

The chord 141 of inked ribbon 140, see FIG. 6, is stretched under tension between tips 218, 220 of two ribbon cartridge arms 204, 206, which are shown in FIG. 11 described below. The ribbon cartridge arm tips 218, 220 and the slot 80 are located approximately in the same plane. The print head assembly 110 has connected thereto two guide plates 148, shown in FIG. 12, which keep the ribbon 140 over the pins of the print head assembly 110. The matrix printing is otherwise conventional except for higher than usual sliding contact pressure by the ribbon 140 over the tip of the print head assembly 110. Bulging of mail into the slot 80 is prevented by relative sizes of a slot and the print head assembly 110. Unusual lumps in mail, which may project into the slot 80, tend to force the print head assembly 110 upward against the linkage follower spring, reducing the possibility of damage from this cause.

Figure 7:
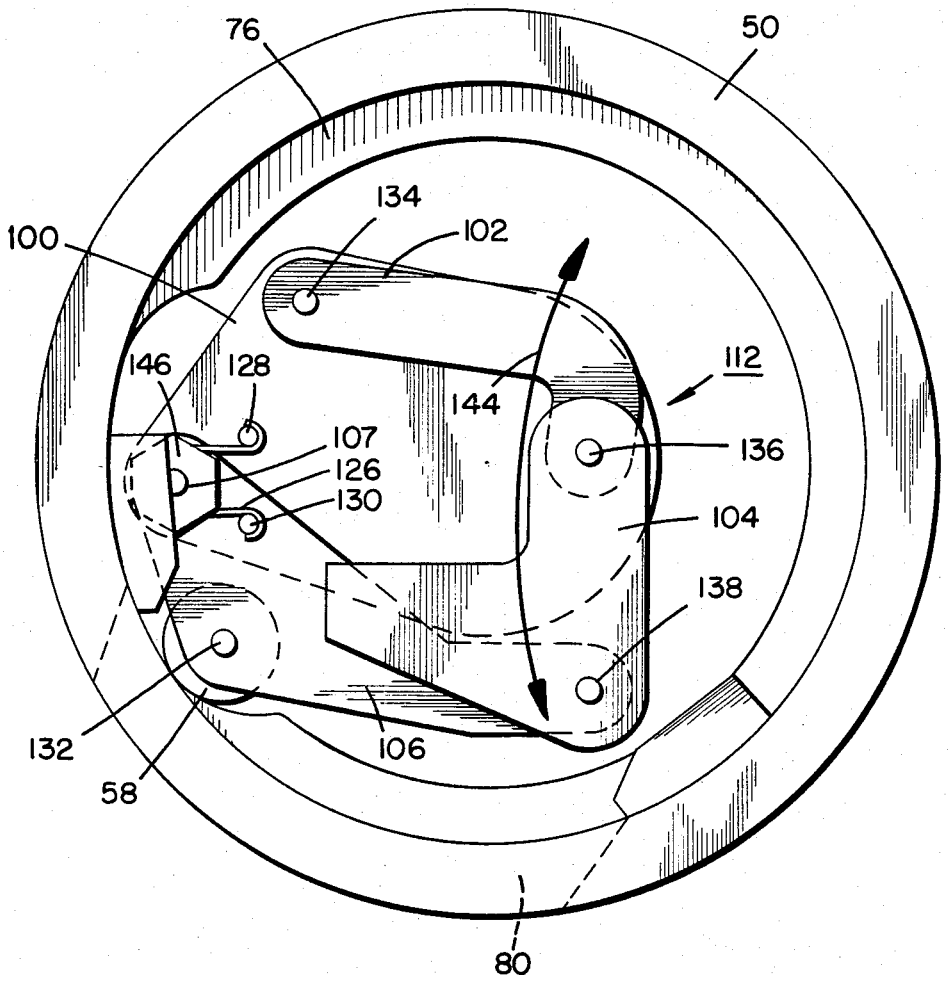
FIG. 7 diagrammatically illustrates the linkages of the print head positioning assembly.

FIG. 7 illustrates the linkages of the print head positioning mechanism 112 which are also located inside the drum 50. The print head assembly 110 has been omitted in FIG. 7 from the illustration to more clearly show the action of the linkage. A linkage support plate 100 is rigidly attached to the non-rotating, hollow shaft 122 (shown in FIG. 9) upon which the drum 50 is rotated. The support plate 100 has movably mounted thereon links 102, 104 and 106. The link 102 is mounted to the plate 100 for movement about a pivot 134. The link 106 is mounted on the plate 100 and pivots about a pin 107. The link 104 is joined to and moves relative to the links 102 and 106 through pivot points 136 and 138, respectively. The link 104, which is fastened to the print head assembly 110, carries the print head assembly 110 (shown in FIG. 6) in such a manner as to reciprocate the print head 114 relative to the drum 50 in cooperating relationship with the drum slot 80. The movement of the link 104 positions the print head 114 in respective printing and non-printing positions.

As the drum 50 turns, the cam 76, being either part of or a discrete element fixed to drum 50, rotates with it and controls the movement of the cam follower roll 58. The cam follower roll 58 is joined to or mounted on the link 106 so that the print head positioning mechanism or assembly 112, and the print head assembly 110 which is mounted on the link 104 (not shown in FIG. 7) moves under the control of the follower roll 58 as it rotates with the drum 50. The print head positioning assembly 112 is biased downward by spring 126 in a direction which maintains contact between follower roll 58 and cam contour 76. The spring 126 is engaged about a spring mount 128 which is attached to the linkage support plate 100 and a spring mount 130 which is mounted on the link 106.

The movement of the printing portion of print head 114 is represented symbolically in FIG. 7 by the arrow 144. The print head 114, in moving from its non-printing position to its printing position or vice-versa, actually moves in a somewhat arcuate path rather than in a strictly linear fashion in this embodiment. By making the path arcuate the print head 114 is slightly displaced from a position directly over its printing position when it is in its non-printing position. This displacement allows greater clearance for installation and removal of the ribbon cartridge 200 from the drum 50 as described in conjunction with FIGS. 14 and 16.

Figure 8:
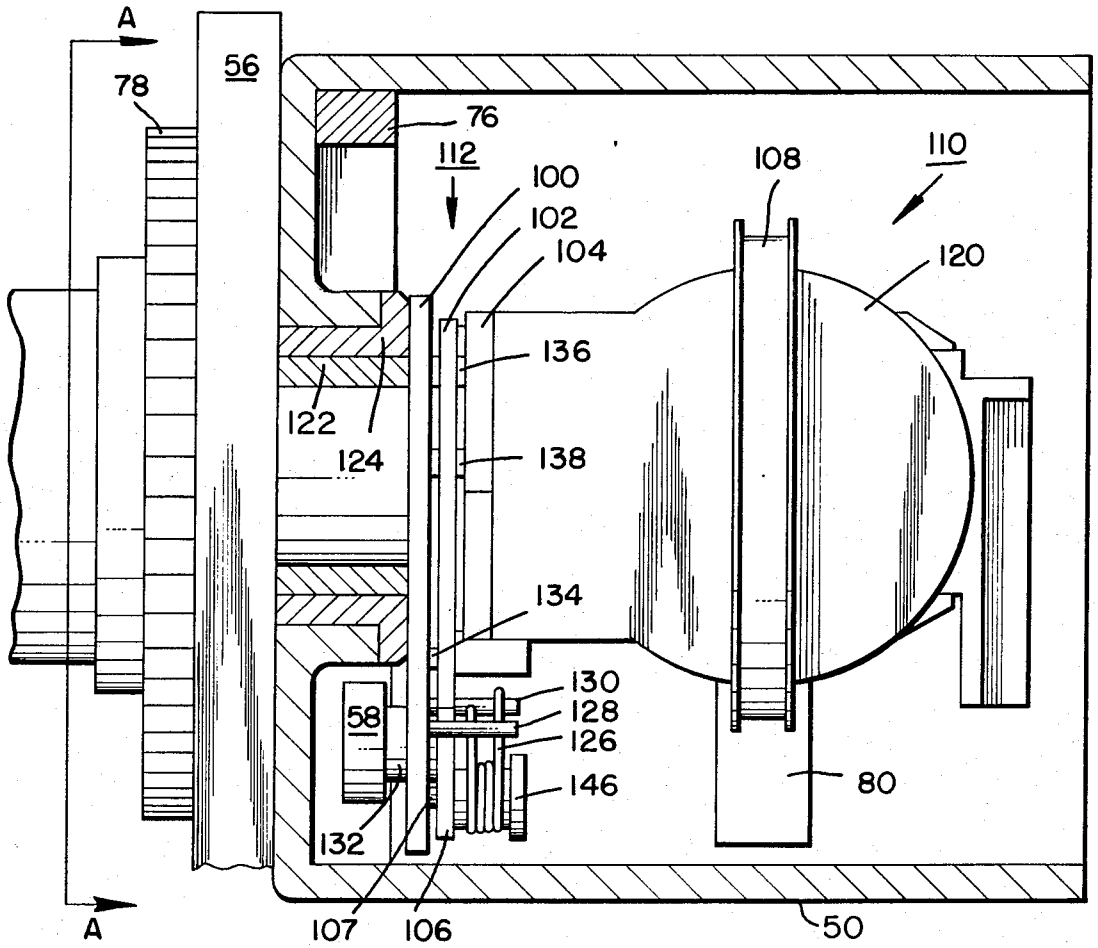
FIG. 8 diagrammatically illustrates a top view of the print drum and print head assembly with the drum and immediate drum shaft area cut away to expose the print head assembly.

FIG. 8 is a top view of the print drum 50 and the print head assembly 110 with the drum 50 and the immediate portion of the drum shaft 122 area cut away to expose the print head assembly 110. The meter uses the fixed, hollow shaft 122 to support the rotating print drum 50. The drum 50 is adapted to rotate about the non-rotating shaft 122 through the use of any suitable means, such as a bearing 124. The linkage support plate 100 is also mounted on the non-rotating shaft 122. The cam follower roll 58 is joined to the link 106 through a pivot stud 132. The spring 126 is mounted on a pivot stud bracket 146, which is mounted on the link 106. The link 106 rotates relative to the pivot point 107.

The drum 50 rotates about the fixed shaft 122, being driven there around by any suitable drive mechanism (not shown). The drive mechanism drives through a gear 78 which is attached to the drum 50. Located between the drum 50 and the gear 78 is the cam 56 which is adapted to control the operation of the pivoting deck 62 and the impression roller 60.

FIG. 9 is a view of the drum 50 and the drum shaft area taken through section A–A of FIG. 8, but without the drum 50 being cut back as in FIG. 8. This figure shows the respective positions of a bearing 124, the gear 78 and the cam 56.

Figure 10:
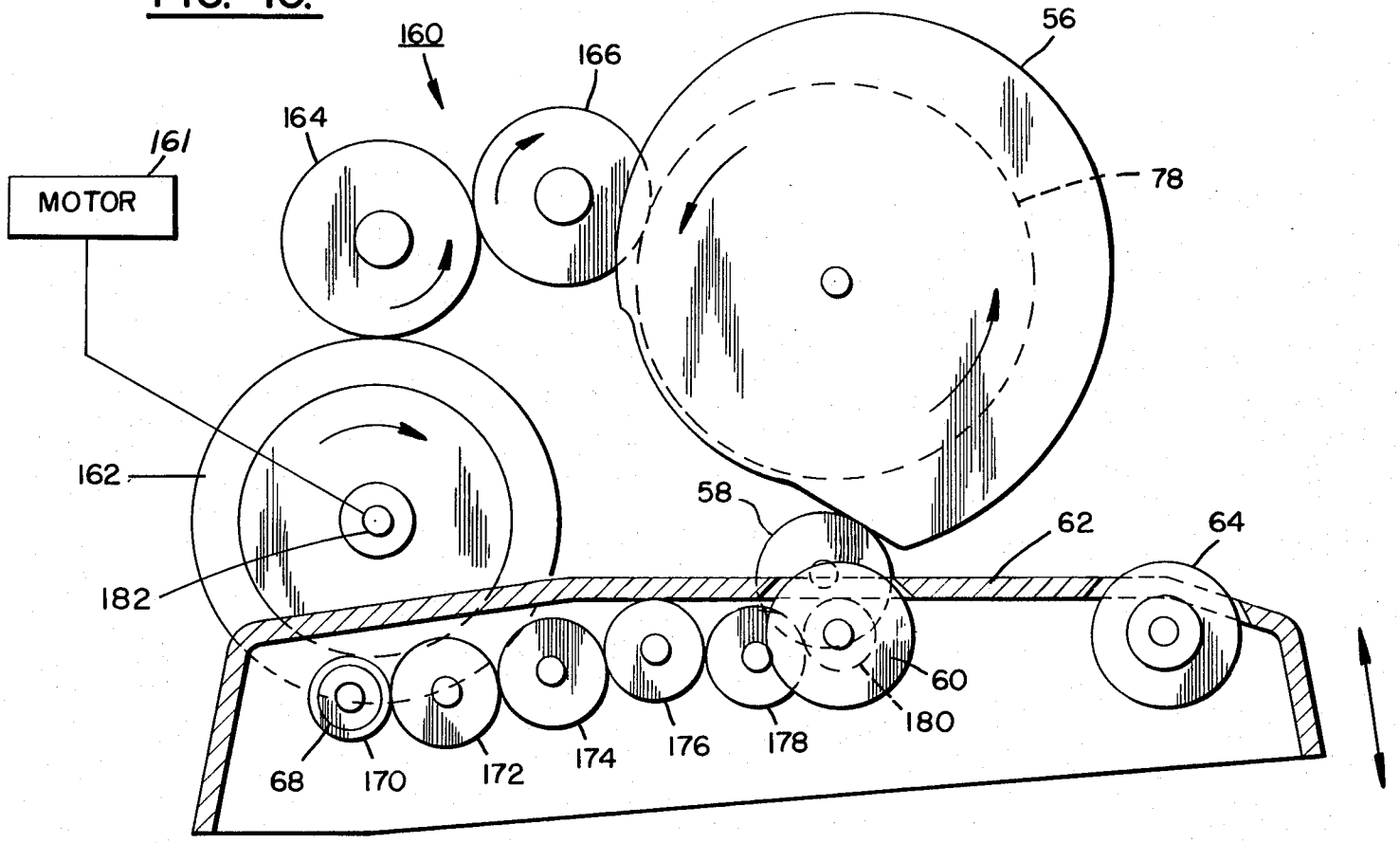
FIG. 10 is a schematic illustration of the drive train for the print drum, exit roller and pivoting deck.

Any suitable drive train can be used to operate the drum 50 and the deck 62 as described. FIG. 10 shows one such apparatus. As a mailpiece 14 is placed into the mail slot 12 of the postage meter, its edge actuates a conventional trip finger to close a switch and start the printing cycle. A suitable drive means, such as a conventional motor 161, drives a gear train 160 which, in turn, rotates the printing drum 50 (not shown in this figure) and the exit feed rollers 64. The motor turns a shaft 182 which successively drives gears 162, 164 and 166. The gear 166 engages the gear 78, which is fixed to the print drum 50 and turns the drum 50 in the counter clockwise direction. The rotation of the gear 78 rotates the cam 56, which is also part of the drum assembly. The pivoting action of the deck 62 causing the deck 62 to rise at a constant velocity until the mailpiece 14 is pinched between the impression roller 60 and a feed knurl 212 on the drum 50. The mailpiece 14 is automatically fed through the printing sequence and the deck 62 is driven gently downward beginning near the trailing edge of the mailpiece 14.

The impression roller 60 is driven through the gear train containing gears 170–180. The impression roller 60 is mounted on the same shaft as the gear 180 and turns therewith. The exit roll 64 can be driven by any suitable means such as belts or gears (not shown) also driven by gear 162. The surface speed of the impression roller 60 is directly synchronized to the drum 50 at all times. Pivoting of the deck 62 is restricted to periods when printing does not occur. The drive system described enables one input to enable a synchronized driving relationship between the drum 50 and the deck 62. Although the print drum 50 can be rotated at any suitable constant speed throughout its cycle, it may also be operated at variable speed. In this manner, throughput of the mailpiece 14 maybe increased without intolerable deterioration of the matrix print quality.

The impact matrix print head 114 forms the variable indicia 30 by activating selected pins as the mailpiece 14 moves relative to it. A particular combination of the pins, controlled by a character generator in the postage meter is activated within print head 114 in each column in sequence. The character generated, in turn, are dependent on the information in the electronic control of the postage meter.

The concept of locating the print head assembly 110 in the print drum 50 has a major advantage over postage meter system wherein the variable and fixed data are printed serially on two separate stations. In a system of that type, the mailpiece 14 must transit between the printers and the manner in which this is done is critical to the proper alignment of the variable and fixed information. In the present system, proper alignment and resulting synchronization is a manufacturing adjustment and not a field service adjustment. Thus, once the system is manufactured and assembled, no further adjustment of synchronization between the two types of printing processes is necessary to obtain proper registration.

Figure 13:
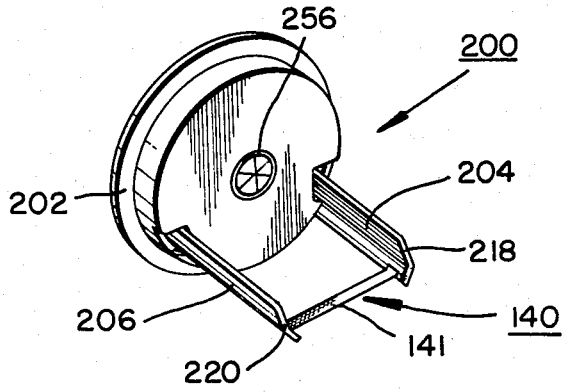
FIG. 13 is a perspective view of the ribbon cartridge.
Figure 12:
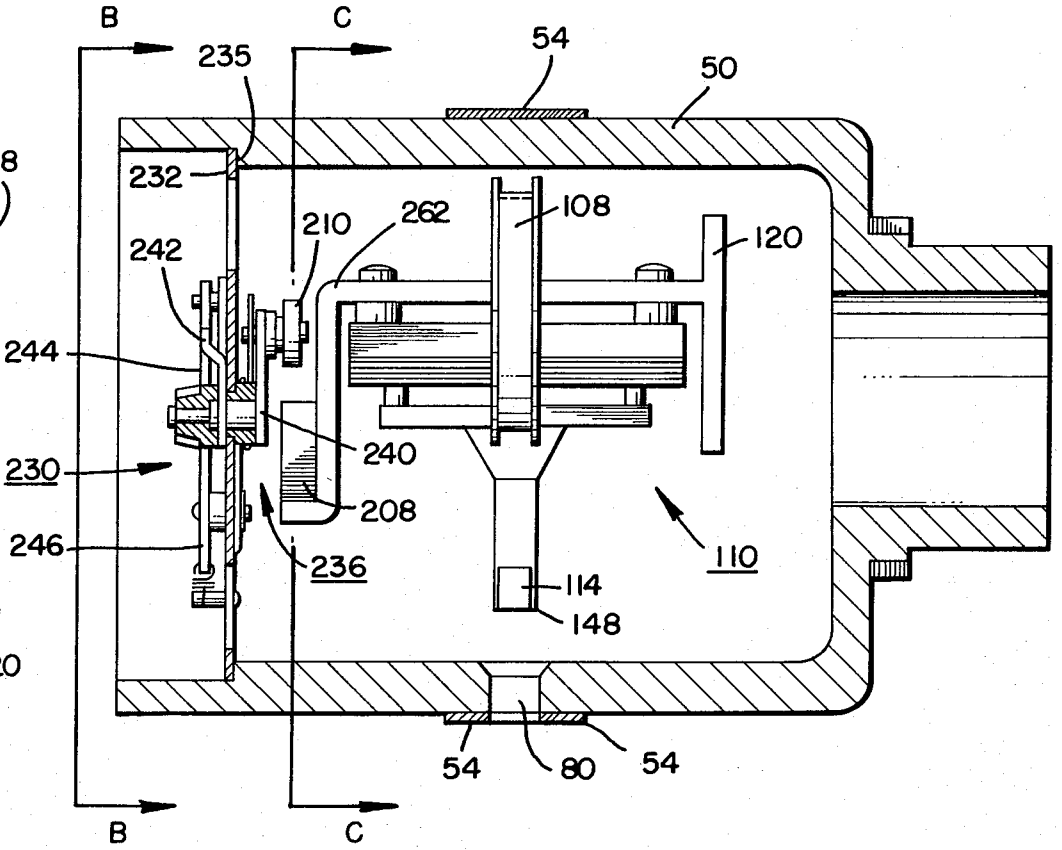
FIG. 12 is a cross-section view of the drum showing the print head assembly and ribbon cartridge feeding assembly.

FIGS. 11 and 12 are illustrations of the cross-section of the ribbon cartridge 200 and the print drum 50 showing some of their respective internal mechanisms. FIG. 13 is a perspective view of the cartridge 200 from the ribbon chord 141 side. The ribbon cartridge 200 is adapted to be disposable. When the spent cartridge 200 is removed, another cartridge 200 with the new ribbon 140 is placed into the drum 50 by the operator. The ribbon 140 is automatically aligned to be installed to function with the print head 114 when it is placed in the drum 50. The ribbon 140 is advanced a small amount during each cycle of the drum 50 by the ribbon feeding assembly 230. After the ink in ribbon 140 has been depleted, an indicator light (not shown) may be displayed to signal to the operator that the cartridge 200 should be replaced. The drum 50 may be inhibited from making any further cycles and the meter from making any further indicia 30 on the mailpiece 14 until the cartridge 200 is replaced. The operator then moves the cartridge 200 and replaces it with a new one.

Figure 14:
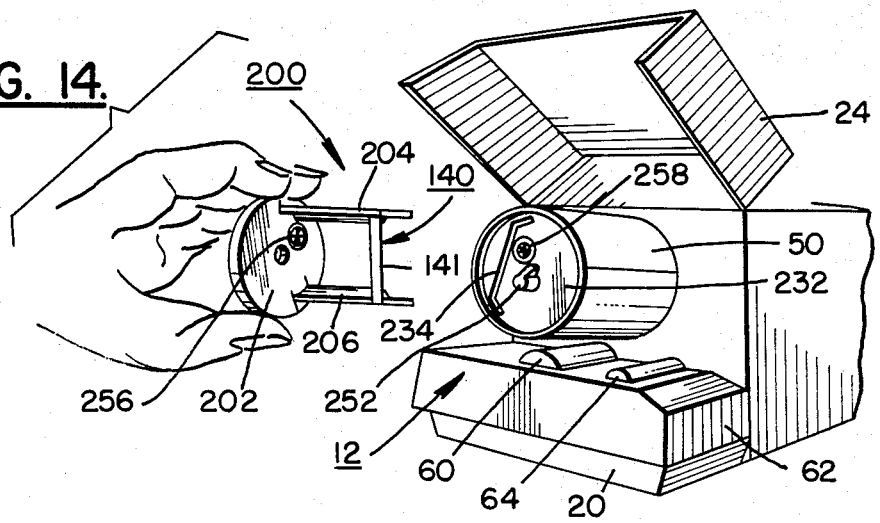
FIG. 14 is a view of the ribbon cartridge and postage meter as the operator prepares to install the cartridge into the meter.
Figure 15:
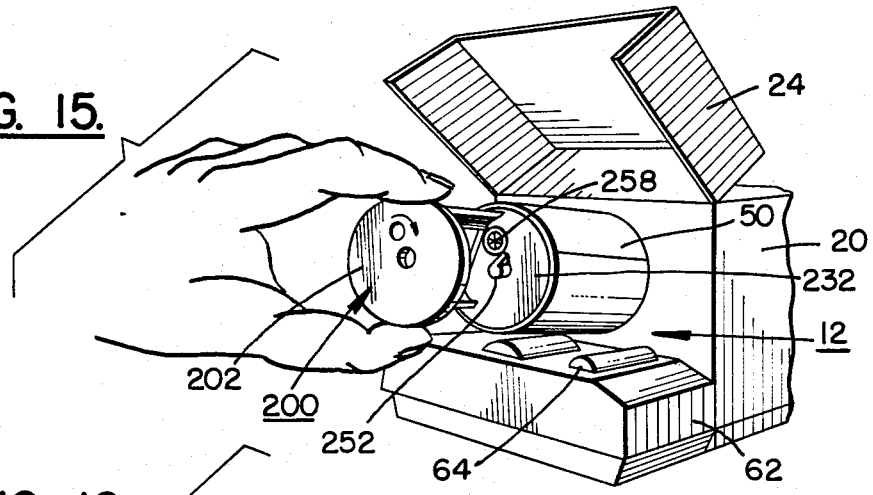
FIG. 15 is a view similar to FIG. 14 showing insertion of the cartridge into the meter.
Figure 16:
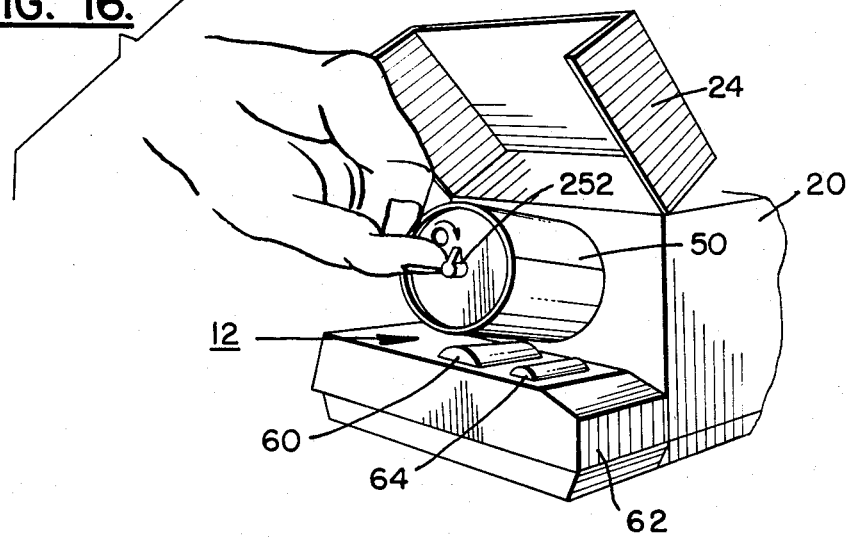
FIG. 16 is a view of the cartridge after it has been placed in its installed position and the operator is about to lock the cartridge in place.

FIGS. 14–16 demonstrate how the cartridge 200 is replaced by the operator. As shown in FIG. 14, the operator grasps the cartridge 200 by his fingers and aligns the cartridge arms 204 and 206 and the ribbon chord 141 with a chord access opening 234. This opening 234 is in the ribbon feed assembly mounting plate 232 which is fastened to the drum 50. Referring to FIG. 15, the operator then inserts the cartridge 200 into and through the mounting plate 232 until the main portion of the cartridge 200 seats itself adjacent the mounting plate 232 so that ratchet faces 256 and 258 are engaged. Then, referring to FIG. 16, the operator operates a lock 252 to lock the cartridge 200 in place so that it cannot inadvertently be removed from the drum 50. The locking of the interlock device signals the postage meter in any suitable manner, such as through electromechanical means, that a new cartridge 200 has been placed in the drum 50 and that the meter is ready to again apply postage impressions. The locking device can be any suitable type which is able to lock the cartridge to the drum. Although the postage meter embodiment described herein has a cartridge locking device, this feature has been omitted from the drawings other than FIGS. 14–16 in the interest of simplicity.

A spring loaded arm (or dancer) 226 located internal to the replaceable ribbon cartridge 200 provides uniform ribbon tension during the rise and fall of the matrix print head 114. Two arms 204 and 206 lead the ribbon 140 in the cartridge 200 from the body of the cartridge 200 and position the ribbon 140 along the chord 141.

An interlock system in the postage meter, depicted generally by the interlock 252 in FIGS. 15 and 16, assures that the disposable ribbon cartridge 200 may only be removed or installed by the user with the drum 50 at its home position. The access cover 24 can only be opened with the drum 50 in home position and the meter cannot be operated with the cover 24 open.

Figure 17:
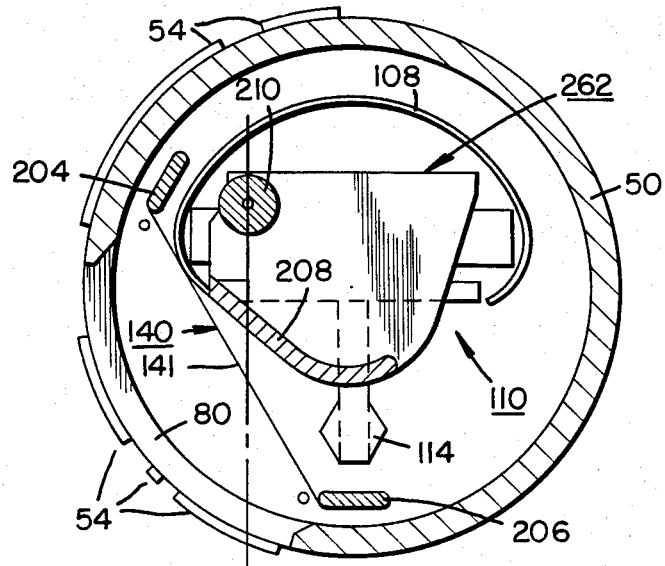
FIG. 17 is a view of the apparatus in FIG. 12 taken through Section C—C with the cartridge of FIG. 11 fully installed therein.
Figure 18:
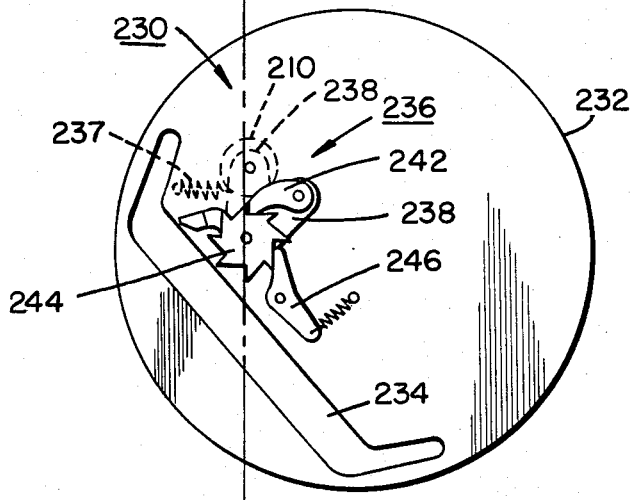
FIG. 18 is a view of the apparatus in FIG. 12 taken through Section B—B.
Figure 19:
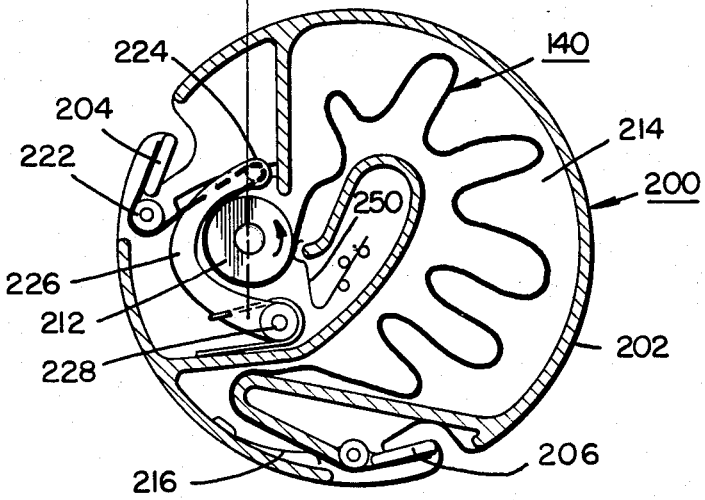
FIG. 19 is a view of the cartridge in FIG. 11 taken through Section A—A.

FIGS. 17 and 18 are views of the apparatus in FIG. 12 taken through sections C—C and B—B, respectively. FIG. 19 is a view of the cartridge 200 shown in FIG. 11 taken through section A—A. These three figures shown the apparatus in its home position.

FIG. 17 shows the arms 204 and 206 of the cartridge 200 in the area of the print head 114. The ribbon 140 is stretched into a chord 141 between these arms 204, 206. The ribbon guide 108 guides the ribbon chord 141 around the nonrotating print head assembly 110 as the drum 50 rotates thereabout and carries the ribbon cartridge 200 with it. A ribbon feed follower roll 210 interacts with the ribbon feed cam surface 208 to return a short length of the ribbon 140 to the cartridge 200 from the chord 141.

Referring to FIG. 18, the feeding assembly 230 includes the feeding assembly mounting plate 232 which is mounted into the recess 235 (see FIG. 12) of the drum 50 in a permanent manner. The mounting plate 232 has the additional function of reinforcing the drum 50 and thus makes the use of a molded drum possible. In the preferred embodiment, the mounting plate 232 is manufactured of steel. The mounting plate 232 has the chord access opening 234 which is dimensioned to allow insertion of the cartridge 200 and thus to clear the chord 141 and the cartridge arms 204, 206 upon installation of the cartridge 200 into the drum 50. The mechanism also includes a ratchet 244. Rotary feed of the ratchet 244 is provided by a spring-loaded feed pawl 242 mounted on a two-arm crank 236 and controlled by an anti-backup pawl 246.

Referring to FIG. 19, the major portion of the length of ribbon 140 is contained within a ribbon storage cavity (or stuffing box) 214. However, the ribbon 140 is passed out of the storage cavity 214 past an exit spring 216 and the cartridge arm 206 to form the ribbon chord 141. After the chord 141 length is formed, the ribbon 140 returns into the body of the cartridge 200, via arm 204 around cylindrical guide 222 and guide roller 224 rotatably mounted on arm (or dancer) 226. It then passes over the knurled ribbon feed roll 212 where it is held in contact with feed roll 212 by spring-loaded shoe 250 and back into the storage cavity 214. With the exception of the cartridge arms 204 and 206, this mechanism is contained within the cartridge housing 202.

The ribbon cartridge 200 is installed into drum 50 with chord 141 straight and under tension. An external knob on feed roll 212 can be used to tighten the ribbon 140 if necessary to remove any slack from chord 141 before installation. Spring loaded dancer 226 is normally slightly deflected to hold the chord 141 under tension between the tips of arms 204 and 206. In normal operation (after the first cycle), the beginning of descent pulls the ribbon 140 through the arm 204 depressing the dancer 226 against its spring. Ribbon 140 withdrawal from the arm 206 is prevented by a conventional leaf spring 216 at the storage cavity 214 exit during this time. Ribbon 140 withdrawal from the storage cavity 214 entrance is prevented by the spring-loaded shoe 250 bearing on the locked feed roll 212.

Continued descent of the print head 114 tip causes the dancer 226 to bottom, preventing further withdrawal of the ribbon 140 through the arm 204. This bottoming increases the ribbon 140 tension and causes withdrawal of a relatively small segment of the ribbon 140 from the storage cavity 214 through the arm 206. At the bottom of descent, continued drum 50 rotation causes no further withdrawal from either arm 204, 206. Constant tension is maintained by the dancer 226 during printing. While the two chord 141 portions on either side of print head 114 tip are constantly changing length during printing, there is no major relative movement between the ribbon 140 and the mailpiece 14. In addition, the length of the ribbon 140 between the cartridge arm tips 218 and 220 remains constant.

After printing, ascent of the print head 114 allows the slack in the ribbon chord 141 to be taken up by the dancer 226 which rises to the highest permitted point of its travel. This action draws the excess ribbon 140 into the arm 204, thus returning the portion of the ribbon 140 between the tips of the arms 218, 220 to a straight chord 141 length. Simultaneously with the print head 114 ascent, a cam 208, mounted on the print head assembly 110, actuates the ribbon feed lever 238 against its spring 237. The lever 238 is held in a "cocked" position after completion of ascent by a dwell on the cam 208. After approximately three quarters revolution of the drum 50, measured from its home position, the "cocked" lever 238 is released, driving pawl 242, ratchet 244 and the feed roll 212 within the cartridge 200 approximately 45 degrees. Rotation of the feed roll 212 drives a small segment of the ribbon 140 into the storage cavity 214 and depresses the dancer 226 somewhat in the process.

The sequence of positions for the drum 50 and the cartridge 200 shown in FIGS. 17–26 depicts the basic concept and operating sequence of the ribbon feeding mechanism 230. The number of components shown in these figures is purposely minimal to simplify the understanding of the operation. The order of events is basically described as they happen, although some inconsequential liberties have been taken with relative timing between the components for purposes of description. Reference is made to the timing charts in FIG. 27 for a more accurate operational timing of the various components.

Each figure in the sequence of FIGS. 17–26 shows the relative position of the key components at a particular point during a single revolution cycle of the print drum 50. FIG. 17 and the (a) section of FIGS. 20–26 depicts a section through the drum 50 showing the print head assembly 110, including the impact matrix print head 114, arranged to reciprocate on a somewhat curved or arcuate path under control of the cam 76 (shown in FIG. 6) during rotation of the drum 50.

FIG. 18 and the (b) sections of FIGS. 20–26 depict the ribbon feed mechanism 230 mounted on the feeding assembly mounting plate 232 which is located and fixed into the internal portion of the drum 50 in the recess 235 (shown in FIG. 12). The ribbon feed follower roll 210, also shown in the (a) sections of FIGS. 20–26, is mounted behind the plate 232 on the two-arm crank 238 which is spring-loaded in a counterclockwise direction.

Figure 20A:
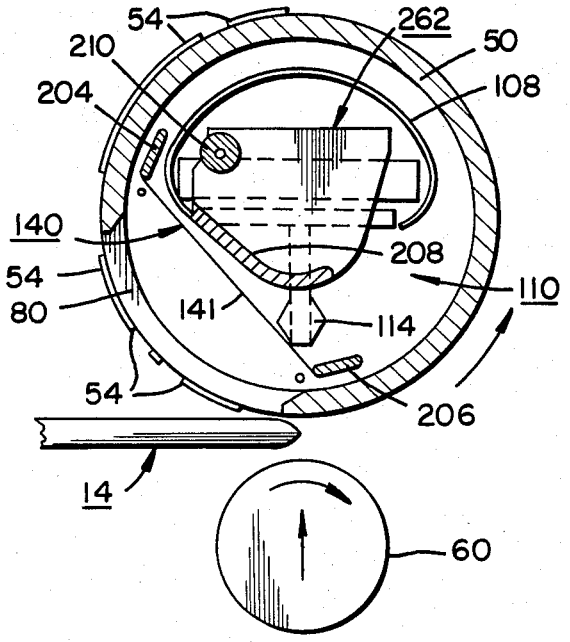
FIGS. 20–26, section (a) only, are sequential views of FIG. 17 at different points in the cycle of the print drum.
Figure 20:
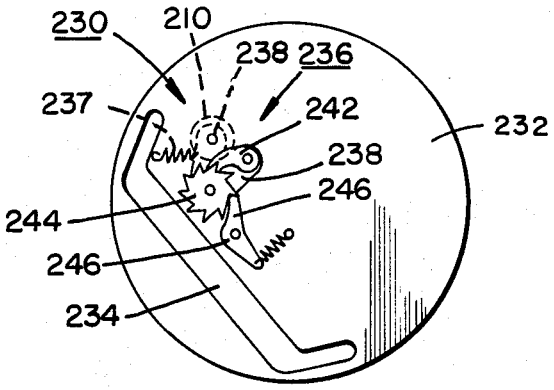
Figure 20:
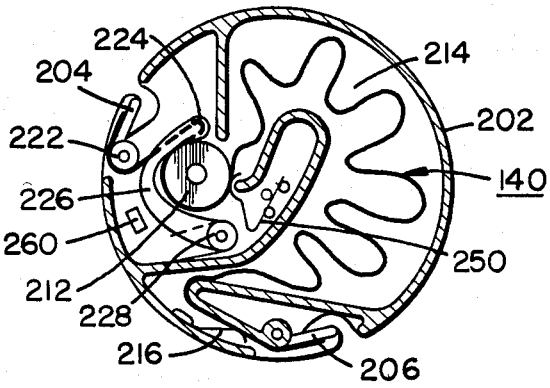
Figure 21:
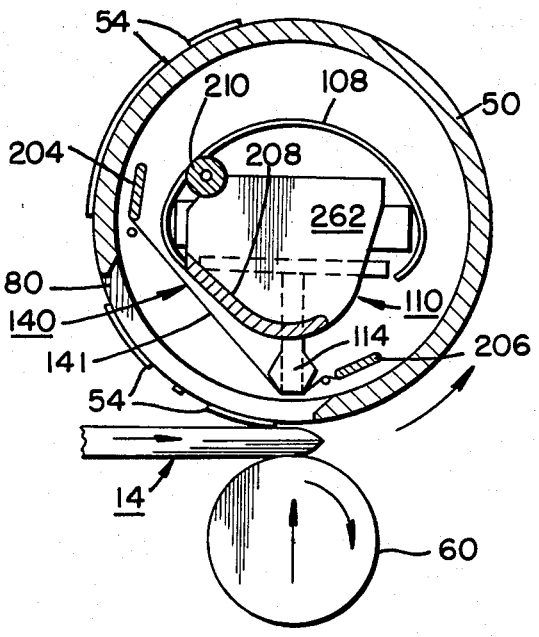
Figure 21:
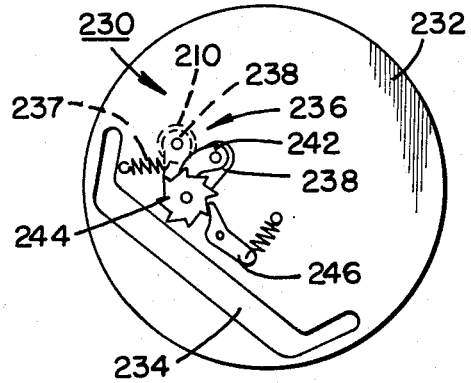
Figure 21:
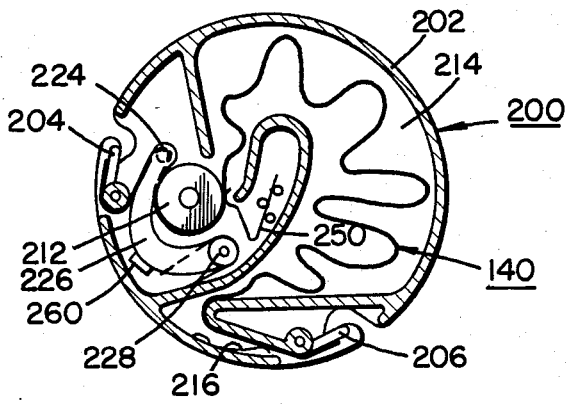

FIGS. 20(a)–(c) show the relative positions of the components after the drum 50 has been driven approximately 55 degrees in a counterclockwise direction from its 0 degree or home position. Up to this point in the cycle, the positions of the reciprocating components within the drum 50 have not changed.

At approximately 67 degrees of rotation, shown in FIG. 21*a*, the print head 114 tip has partially descended, deflecting the ribbon chord 141 from its straight line orientation between the cartridge arm tips 218 on arm 204, and 220, on arm 206. This pulls the dancer 226 downward into contact with the down-stop surface 260. With the lightly spring-loaded dancer 226 prevented from absorbing further ribbon 140 once it is stopped by the down-stop 260, tension in the chord 141 increases. The increased tension causes additional ribbon 140 to be withdrawn from the storage cavity 214 through the exit spring 216 and arm 206 as descent of the print head 114 continues. Impression roll 60 rises during this period under control of cam 76 pressing mailpiece 14 against rotating drum 50 initiating feed of mail piece 14.

Figure 22:
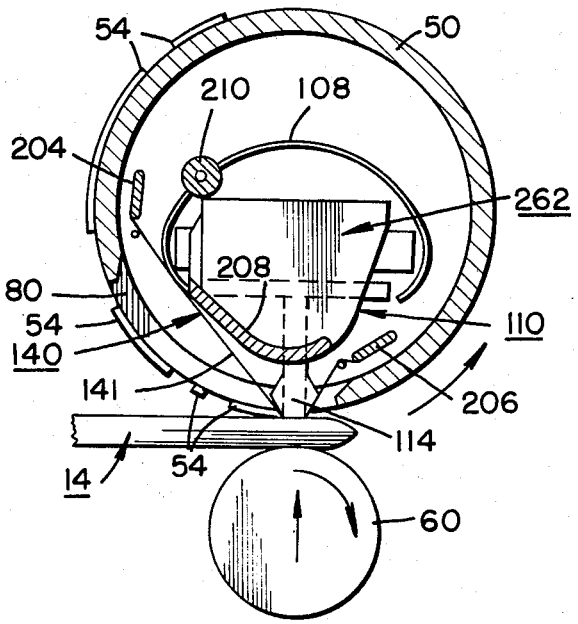
Figure 22:
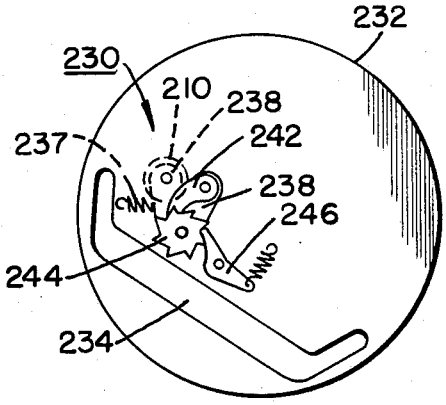
Figure 22:
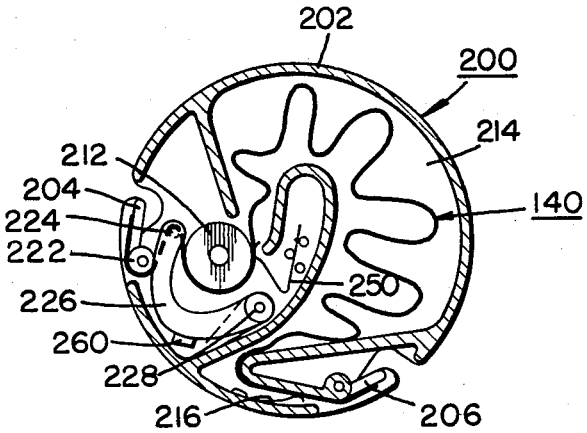

With completion of descent at about 71 degrees, as shown in FIGS. 22 (*a–c*), approximately ¼ inch of the ribbon 140 has been withdrawn from the storage cavity 214 and light tension is maintained on the ribbon 140 by the dancer 226. The print head 114 tip is now fixed in its lowermost position within the slot 80 in the drum 50. The ribbon 40 is restrained from side-slipping off the print head 114 tip by thin guide flanks, 148 (best shown in FIG. 12), fastened to the flanks of the tip of the print head 114.

Figure 23:
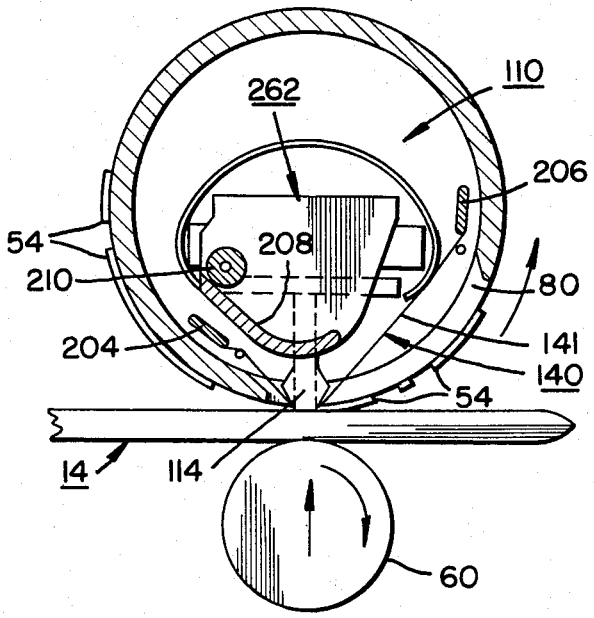
Figure 23:
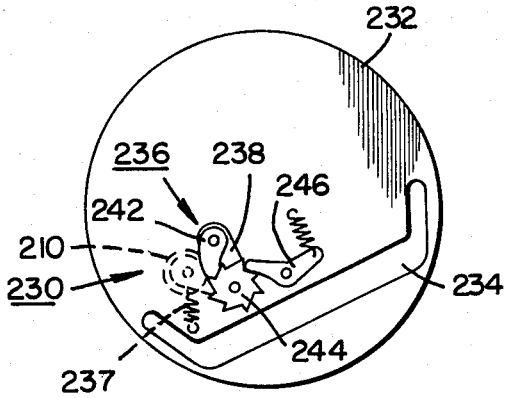
Figure 23:
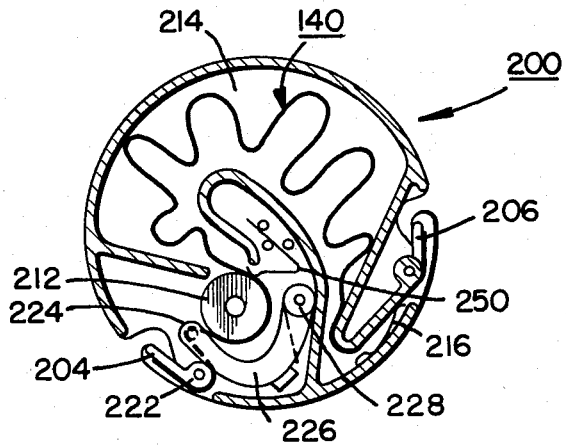

At the completion of printing, the ribbon feed follower roll 210 has rotated into contact with the cam surface 208 attached to the print head mounting bracket 262. The rise of the print head 114, beginning at approximately 125½ degrees in the drum cycle, as shown in FIG. 23 (*a–c*), causes the cam 208 to engage the ribbon feed follower roll 210. Further rotation of drum 50 and ascent of cam 208 forces the ribbon feed arm to rotate clockwise against its spring-loading. This advances the feed pawl 242 one tooth on the ratchet 244. The ratchet 244, remains fixed by the anti-backup pawl 246 and does not rotate. Simultaneously, during the rise of the print head 114, the ribbon 140 is restored to a straight chord length 141 (such as shown in FIG. 17), and the dancer 226 takes up the ribbon slack in the clockwise direction away from the downstop 260.

Figure 24:
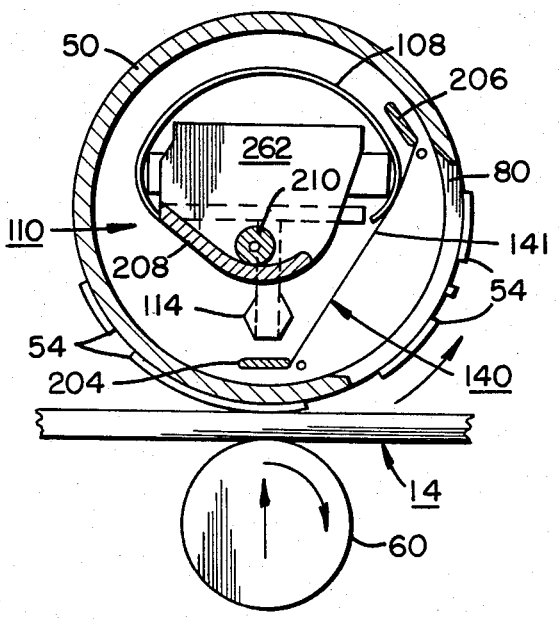
Figure 24:
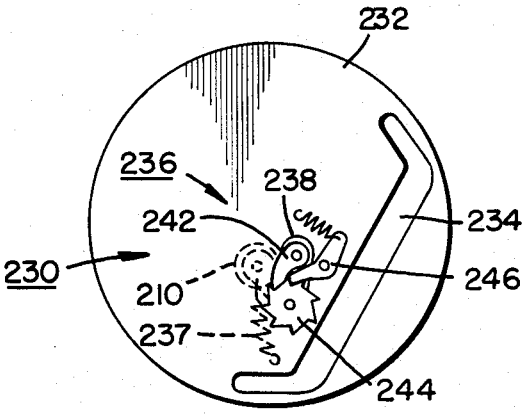
Figure 24:
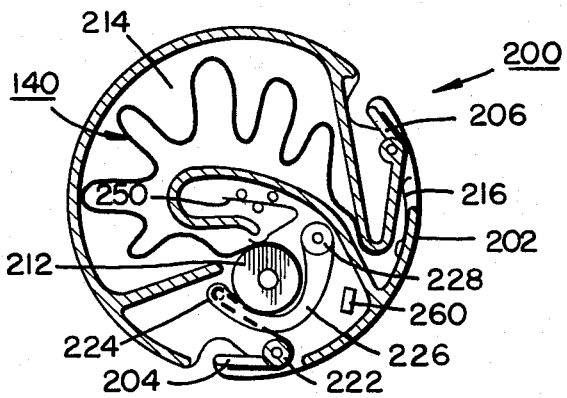
Figure 26:
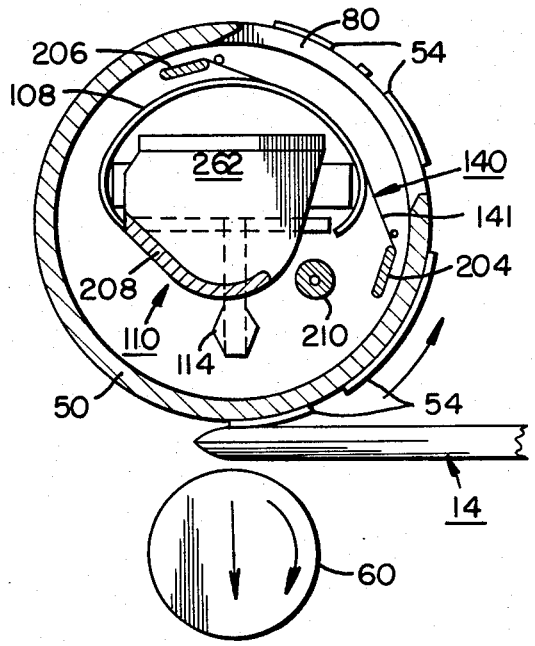
Figure 26:
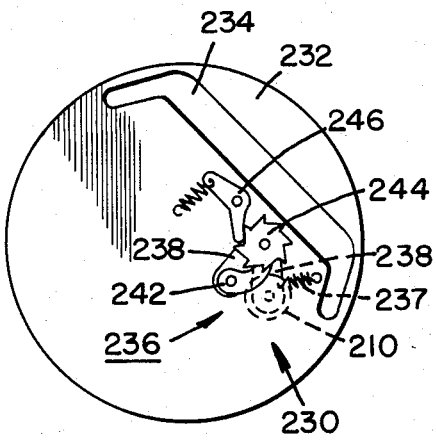
Figure 26:
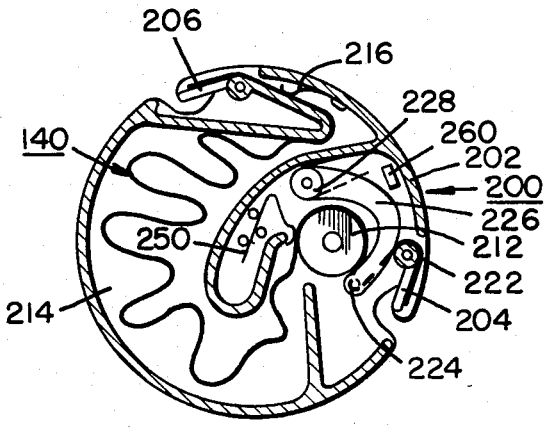
Figure 25:
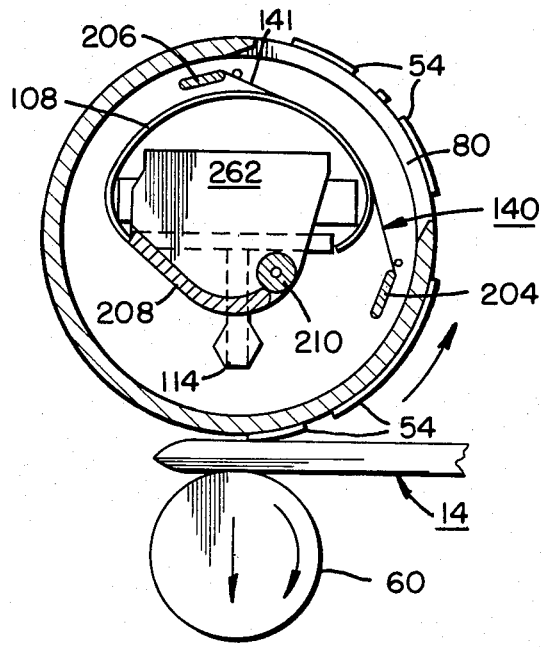
Figure 25:
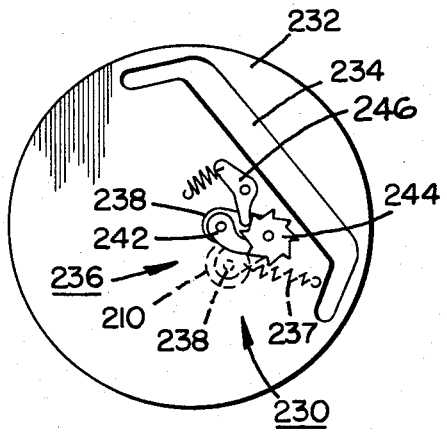
Figure 25:
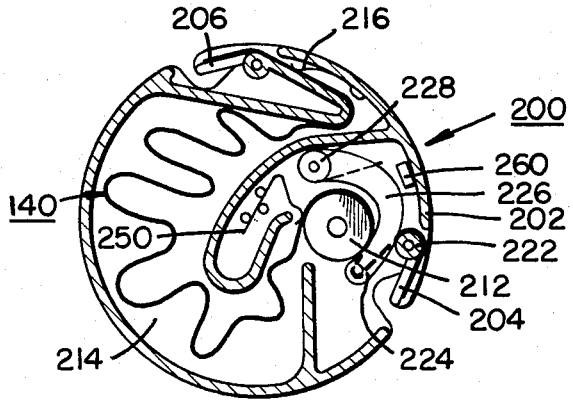

With completion of the rise of the print head 114 at approximately 143 degrees of drum cycle, as shown in FIG. 24, the print head 114 is maintained in its "up" position. The ribbon feed follower roll 210 has advanced past that portion of its activating cam surface 208 which provides a controlled advance of the crank arm 240 and enters a dwell period. During this period, the arm 240 is maintained in a "cocked" (or clockwise) position. The ribbon chord 141 has rotated tangent to the track of the ribbon guide 108. The ribbon guide 108 guides the ribbon 140 clear of the print head assembly 110 within the drum 50 as shown in FIGS. 25 and 26. This arrangement allows a more compact drum design by the simple provision of assuring clearance of the print head assembly 110 by ribbon 140 as the drum 50 completes its cycle.

Continued rotation of the drum 50, which may include the printing of a fixed indicia advertisement after printing the variable information via the print head 114, causes the deck 62 (see FIG. 5) to be driven downward by its control cam 56. This releases the feed action on the mailpiece 14 by the drum 50. The feeding of the mailpiece 14 is transferred to the set of conventional power-driven exit rollers 64. Release may occur at any point over the approximate range of 206 degrees to 263 degrees of the drum cycle, depending on the thickness of the mailpiece 14, as shown in FIG. 25 (*a–c*).

Continuation of the drum 50 rotation allows the ribbon feed follower roll 210 to drop off the end of the dwell portion of the cam surface 208 at approximately 266 degrees, as shown in FIG. 26. This "fires" the spring-loaded feed arm 210 and attached feed pawl 242 to advance the ratchet 244 one tooth in the counterclockwise direction. This action drives the feed roller 212, in the cartridge 200, approximately 45 degrees to enter approximately ¼ inch length of ribbon 140 into the storage cavity 214. This also causes the dancer 226 to be pulled downward, in a counterclockwise direction, against its spring loading.

Further rotation of the drum 50 produces no event of significance and all components maintain their relative positions as the drum 50 completes its cycle and returns to its home position ready for the next entry of a mailpiece 14.

Figure 27:
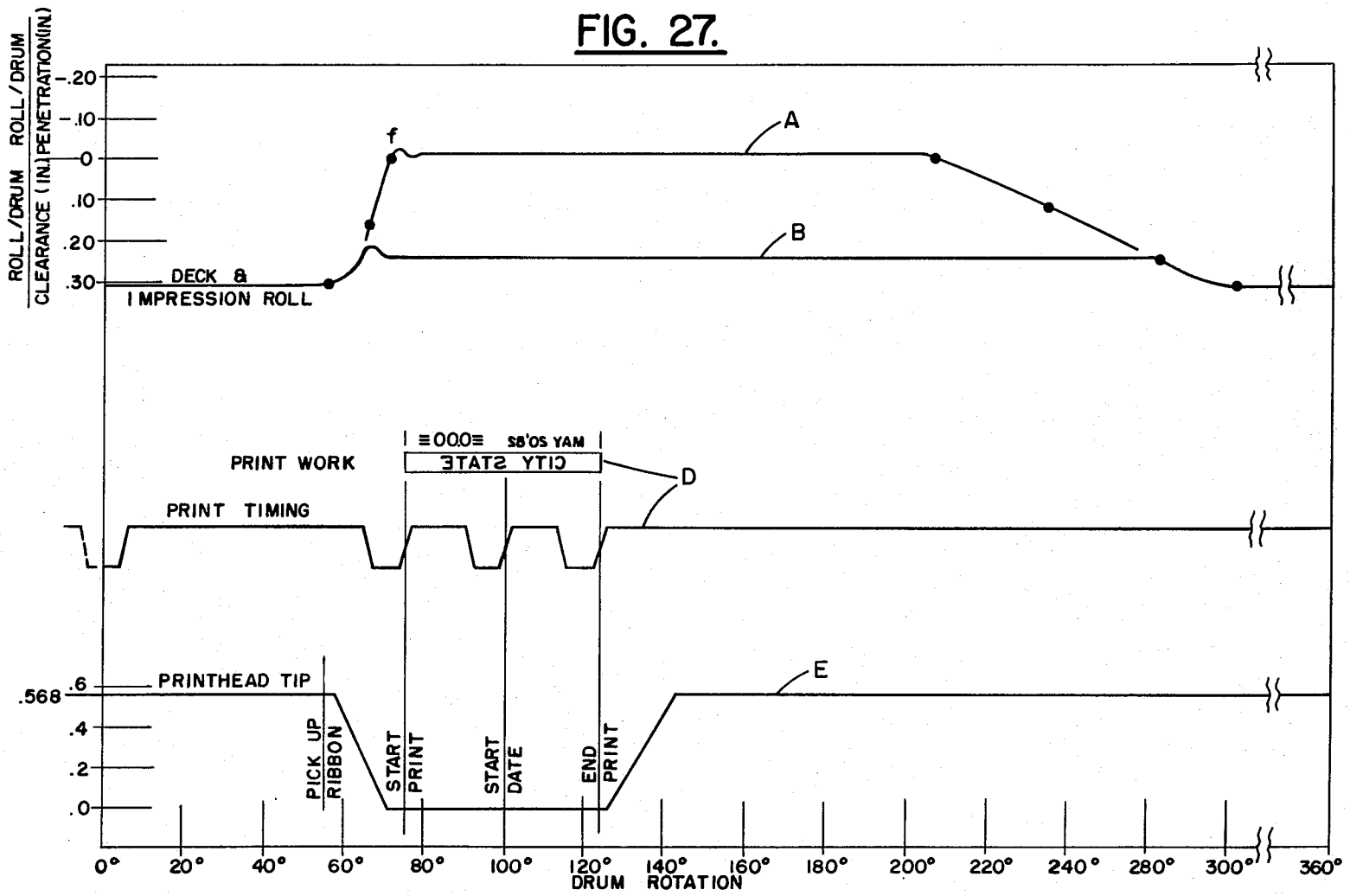
FIG. 27 is a timing diagram of the various components in the postage meter.

Reference is made to FIG. 27 for an approximate timing of the activation of the various elements described above in conjunction with FIGS. 17–26 as well as their relationship to the position of the drum 50 during its cycle. One cycle is 360 degrees. More specifically, the upper curves A and B show the position of the impression roller 60 face relative to the face of the drum 50. Movement of the impression roller 60 is, of course, accomplished by movement of the mailpiece deck 62 on which the impression roller 60 is carried. The horizontal coordinate of the curves in FIG. 27 is the degree of rotation of the drum 50 about its axis. The vertical coordinate of curves A and B is the vertical displacement of roll 60 and shows various amount of clearance, abutment, or penetration between the face of the drum 50 and the impression roller 60. The curve A represents the relative position of the faces of the drum 50 and the impression roller 60 when no mailpiece or a very thin mailpiece 14 is disposed intermediate these faces. The upstop, referred to above, limits the upward travel of the deck 62 thereby limiting the over travel of the impression roller 60 during impact compression of the rubber on roll 60, as shown at point "f". This limits impact forces on the drum 50 and, thus, enables the use of low cost, lower strength drum materials feasible in the apparatus. The curve B shows the relative positions of these faces when a thick mailpiece 14 is intermediate the faces. The curve D shows the timing of the variable and fixed print indicia 36 during the rotational cycle of the drum 50. The curve E shows the radial position of the tip of the print head 114 relative to the face of the drum 50.

It should be understood that the foregoing description and timing is only illustrative of the invention. Alternatives and modifications in the structural and functional features and timing of the postage meter can be devised by those skilled in the art with out departing from the invention. Accordingly, the present invention is intended to embrace all such alternatives, modifications and variations which fall within the spirit and scope of the appended claims.

What is claimed is:

1. A postage meter printing apparatus for applying postage indicia to a mailpiece comprising:

(a) a rotary operating drum means for feeding the mailpiece through the postage meter, the periphery of the drum means having an aperture therein, (b) means for maintaining the mailpiece against the drum means as the mailpiece is fed by the drum, (c) means to cycle the drum means, (d) a reciprocating print head means located internal to the drum means having a printing position and non-printing position, the print head means being automatically placed adjacent the mailpiece through the aperture in the drum means to its printing position when the aperture is between the print head means and a mailpiece, the print head means being an impact matrix print head, and (e) a replaceable cartridge located on and rotating with the drum means, the cartridge having first and second arms extending into the drum means, the cartridge containing an inked ribbon means, the print head means and inked ribbon means cooperate to print on the mailpiece, (f) means to activate the print head means when it is in its printing position, and (g) means associated with the print head means to advance the ribbon on activating of the print head means.

2. The apparatus as described in claim 1 wherein the replaceable cartridge is secured to the drum means.

3. The apparatus as described in claim 2 wherein the drum means includes a generally circular plate.

4. The apparatus as described in claim 3 wherein the replaceable cartridge extends through an aperture disposed in the plate.

5. The apparatus as described in claim 4 wherein the ribbon extends intermediate the first and second arms and during at least a portion of the cycle of the apparatus is disposed intermediate the first and second arms within a single plane.

* * * * *